US010836456B2

(12) United States Patent
Lee et al.

(10) Patent No.: US 10,836,456 B2
(45) Date of Patent: Nov. 17, 2020

(54) APPARATUS FOR PASSIVELY PREVENTING MARINE FLOATING BODY FROM TWISTING DURING MOORING

(71) Applicant: Korea Institute of Ocean Science & Technology, Ansan-si (KR)

(72) Inventors: Kang Su Lee, Incheon (KR); Byoung Jae Park, Daejeon (KR); Min Suk Ki, Sejong (KR); Hyun Seok Kim, Seoul (KR)

(73) Assignee: Korea Institute of Ocean Science & Technology, Gyeonggi-do (KR)

( * ) Notice: Subject to any disclaimer, the term of this patent is extended or adjusted under 35 U.S.C. 154(b) by 0 days.

(21) Appl. No.: 16/349,517

(22) PCT Filed: Oct. 31, 2017

(86) PCT No.: PCT/KR2017/012198
§ 371 (c)(1),
(2) Date: May 13, 2019

(87) PCT Pub. No.: WO2018/093070
PCT Pub. Date: May 24, 2018

(65) Prior Publication Data

US 2019/0337595 A1 Nov. 7, 2019

(30) Foreign Application Priority Data

Nov. 15, 2016 (KR) ..... 10-2016-0151957

(51) Int. Cl.
*B63B 21/10* (2006.01)
*B63B 21/16* (2006.01)
(Continued)

(52) U.S. Cl.
CPC ..... *B63B 21/10* (2013.01); *B63B 21/16* (2013.01); *B63B 21/50* (2013.01);
(Continued)

(58) Field of Classification Search
CPC ..... B63B 21/00; B63B 21/04; B63B 21/08; B63B 21/10; B63B 21/14; B63B 21/16; B63B 21/18; B63B 21/50
(Continued)

(56) References Cited

U.S. PATENT DOCUMENTS 4,476,801 A * 10/1984 Foster ..... B63B 21/50 114/230.23
4,679,800 A 7/1987 Burton
(Continued)

FOREIGN PATENT DOCUMENTS

JP 2001-055190 A 2/2001
JP 2008-037143 A 2/2008
(Continued)

OTHER PUBLICATIONS

International Search Report (PCT/ISA/210) for PCT International Application PCT/KR2017/012198 dated Feb. 21, 2018. (Translation Included).

*Primary Examiner* — Lars A Olson
(74) *Attorney, Agent, or Firm* — Harness, Dickey & Pierce, P.L.C.

(57) ABSTRACT

The present invention relates to an apparatus for passively preventing a marine floating body from twisting during mooring by controlling tension in ropes connected to the marine floating body within a predetermined allowable limit. The apparatus includes: a floating main body connected to the ropes, fixed on the sea, and providing a space for marine work; winches disposed on the floating main body and retracting or releasing the ropes fixing the floating main body; fairleads disposed on portions of the floating main body and guiding the ropes to the winches through themselves; and braking units disposed on portions of the floating main body at a predetermined distance from the fairleads, with the ropes passing through the fairleads and
(Continued)

themselves, and controlling a speed of the ropes that are retracted to the winches at a predetermined speed.

3 Claims, 4 Drawing Sheets

(51) Int. Cl.
*B63B 21/50* (2006.01)
*B66D 5/26* (2006.01)

(52) U.S. Cl.
CPC ..... *B63B 2221/08* (2013.01); *B66D 5/26* (2013.01); *B66D 2700/035* (2013.01)

(58) Field of Classification Search
USPC ..... 114/180, 200, 230.23, 230.26; 115/230.23
See application file for complete search history.

(56) References Cited

U.S. PATENT DOCUMENTS

| | | | | | |
|---|---|---|---|---|---|
| 4,862,821 | A * | 9/1989 | Ballantyne | B63B 21/04 | 114/293 |
| 5,730,425 | A * | 3/1998 | Brooks | B63B 21/18 | 114/293 |
| 8,291,848 | B2 * | 10/2012 | Fenini | B63B 21/16 | 114/230.25 |
| 8,544,400 | B2 * | 10/2013 | Hovik | B63B 21/08 | 114/200 |
| 2014/0026796 | A1 * | 1/2014 | Leverette | B63B 21/50 | 114/230.24 |

FOREIGN PATENT DOCUMENTS

| | | | |
|---|---|---|---|
| KR | 10-2009-0129003 | A | 12/2009 |
| KR | 10-20012-0091816 | A | 8/2012 |
| KR | 200476623 | Y1 | 3/2015 |

* cited by examiner

【Figure 1】
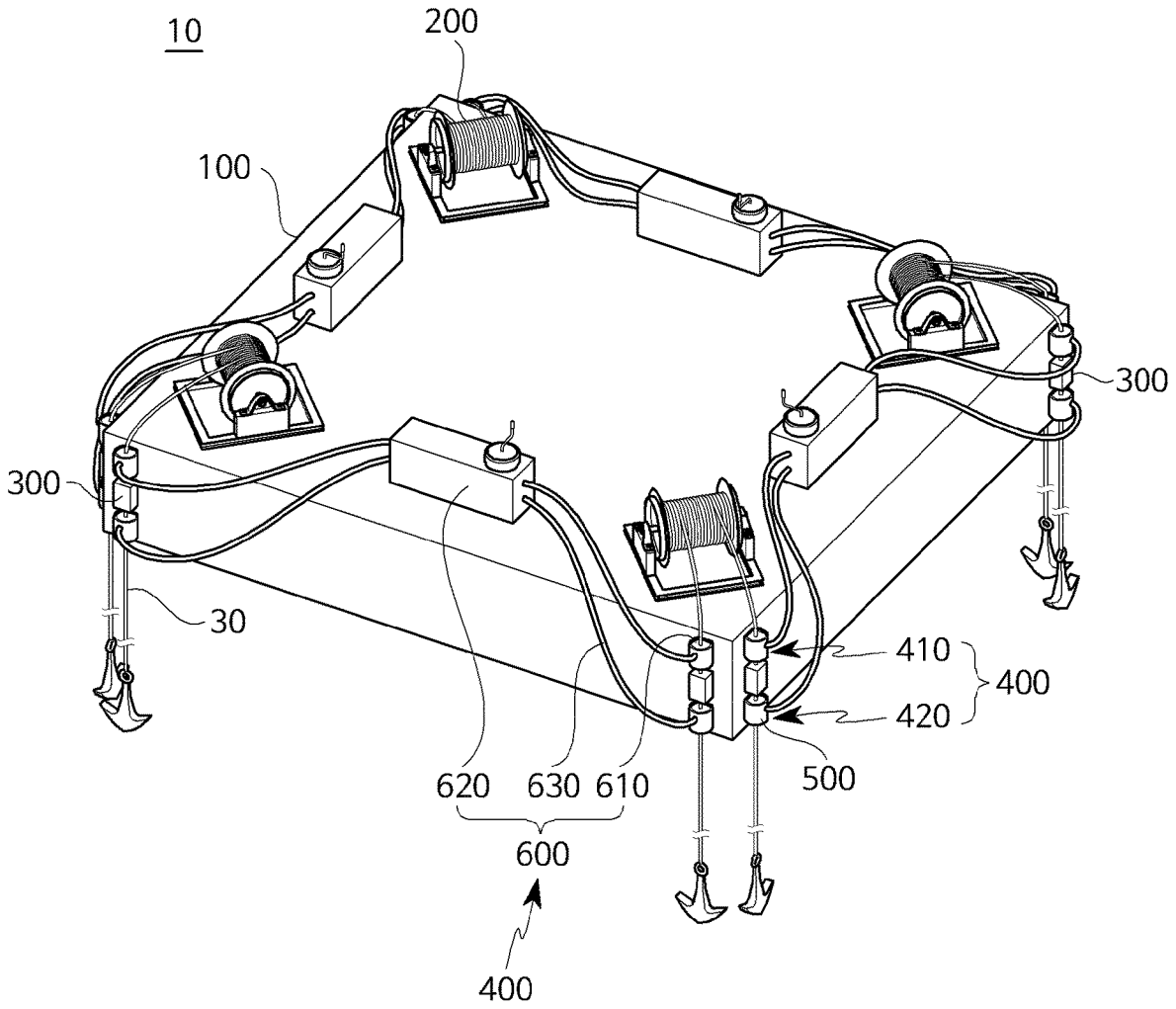

【Figure 2】
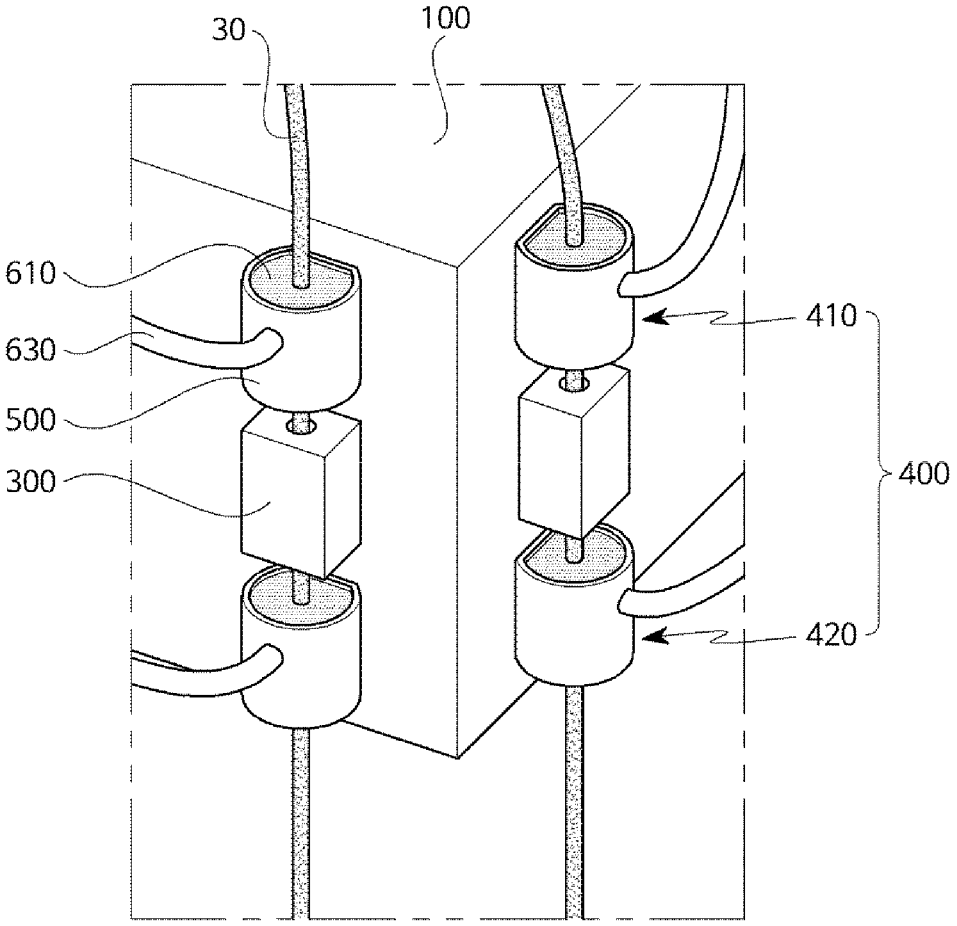

【Figure 3】
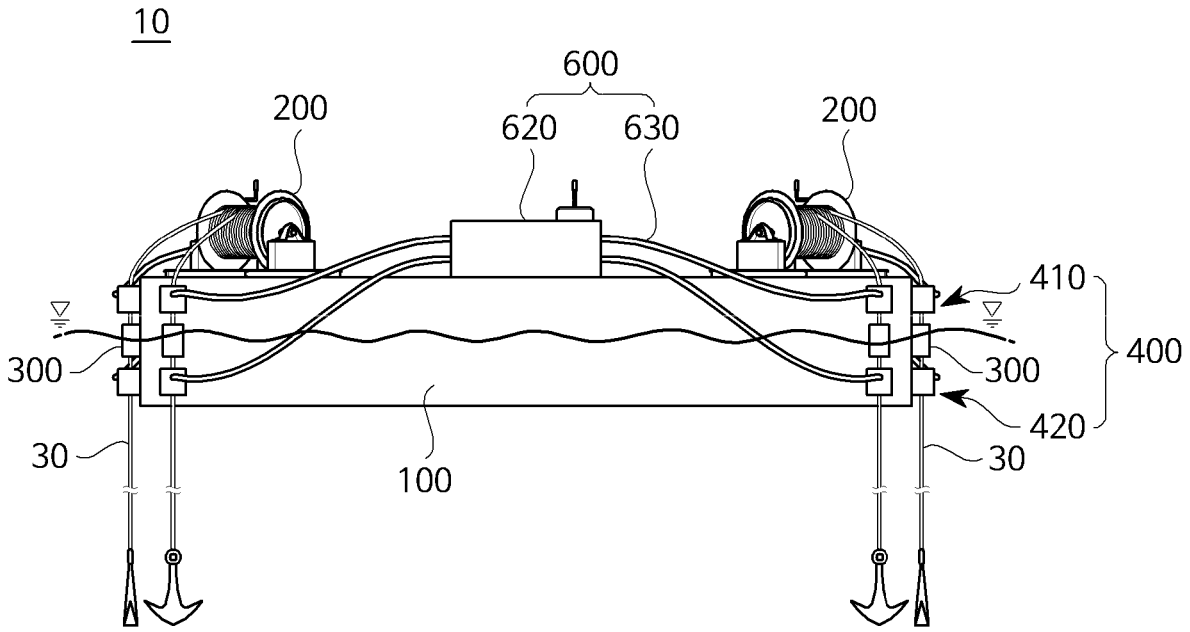

【Figure 4】
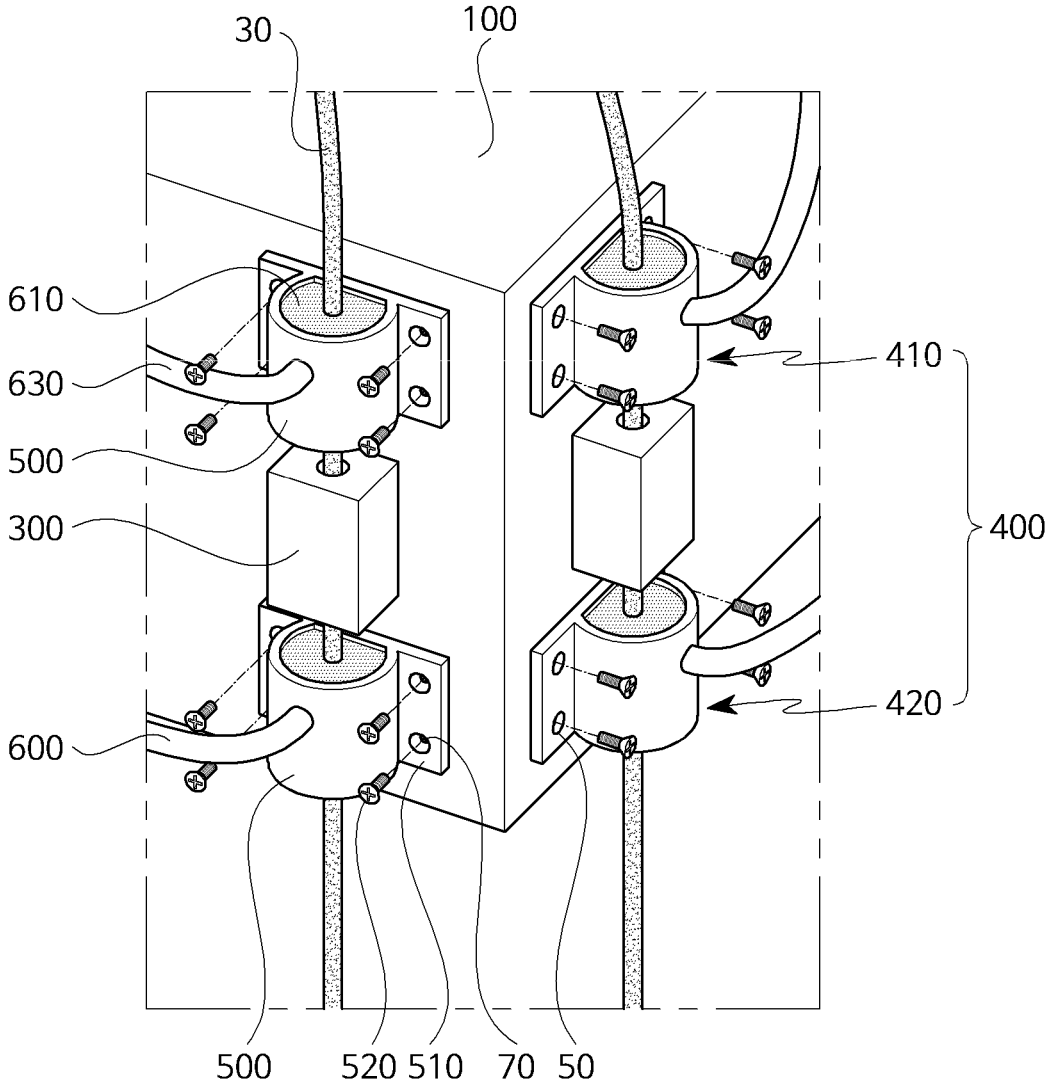

APPARATUS FOR PASSIVELY PREVENTING MARINE FLOATING BODY FROM TWISTING DURING MOORING

CROSS-REFERENCE TO RELATED APPLICATIONS

This application is a national phase under 35 U.S.C. § 371 of PCT International Application No. PCT/KR2017/012198 which has an international filing date of Oct. 31, 2017, which claims priority to Korean Application No. 10-2016-0151957, filed Nov. 15, 2016, the entire contents of each of which are hereby incorporated by reference.

TECHNICAL FIELD

The present invention relates to an apparatus for preventing a floating facility mooring on water from twisting and, more particularly, to an apparatus for passively preventing a marine floating body from twisting during mooring by controlling a return speed of mooring ropes through pressurization by external force.

BACKGROUND ART

In general, bridges on the sea for connecting islands that are far from the mainland, dolphin type docking facilities, or breakwaters are structures installed on the sea and are constructed by reinforced concrete.

A floating type structure that floats on the sea is very advantageous for these marine structures in terms of the construction costs rather than a weight type structure that is erected by its own weight, so the floating type is used for constructing various marine structures.

Such floating type structures float on the sea with the main body partially sunk in the sea and should have a floating space for providing buoyancy to the structures and a mooring apparatus for preventing the structures from being pushed by waves.

Such floating type structures can be constructed by manufacturing units in advance at a factory on the ground close to the shore using a concrete material, launching the units onto the seawater using a crane etc., and then connecting the units to each other.

Alternatively, a main body may be constructed as a structure by manufacturing floating type concrete units at a dry dock adjacent to the shore, filling the dry dock with seawater by opening a floodgate of the dry dock, launching the units onto the seawater, and the connecting the floating type concrete units to each other.

Alternatively, a structure may be constructed by putting a large floating dock on the seawater, manufacturing floating type concrete units on the floating dock, sinking the floating dock at the predetermined height in the seawater, and then connecting the floating type concrete units.

Meanwhile, the mooring apparatuses of such floating structures of the related art generally use cables or chains. In this case, a plurality of cables or chains is connected to the bottom of a floating structure and the ends of the cables or chains are fixed to anchors to prevent the structures from being pushed by waves. However, these mooring apparatuses of the related art have difficulty in appropriately coping with changes in sea level due to waves generated on the seawater or a tidal range.

For example, according to mooring apparatuses of the related art, since ends of cables or chains are fixed to the bottom of a main body of a floating type structure and the other ends are fixed to anchors, the floating type structure moves down when the sea level decreases due to a tidal range, so the cables or the chains loosen and sag down. Accordingly, the floating type structure is moved and a stable mooring effect is difficult to achieve.

Further, when the sea level rises, the floating type structure also moves up, so excessive tension is generated in the cables or the chains, whereby the cables or the chains may be broken. Accordingly, it is required to provide a large tolerance when designing cables or chains and anchors in order to prevent this problem, but the tolerance is excessive, so the construction costs are increased and it is difficult to construct a stable floating type structure on the sea.

DOCUMENTS OF RELATED ART

[Patent Document]

Korean Patent Application Publication No. 10-2009-0129003 (title: Mooring Apparatus for a Floating Structure Using Weights)

DISCLOSURE

Technical Problem

The present invention has been made in an effort to solve the problems and an object of the present invention is to provide an apparatus for passively preventing a marine floating body from twisting during mooring, the apparatus having a function of controlling an allowable limit of tension under a Mooring Breaking Limit (MLB) through pressurization by external force to limit a limit twisting angle (theta) due to weather waning.

Technical Solution

In order to achieve the objects of the present invention, there is provided an apparatus for passively preventing a marine floating body from twisting during mooring by controlling tension in ropes connected to the marine floating body within a predetermined allowable limit. The apparatus includes: a floating main body connected to the ropes, fixed on the sea, and providing a space for marine work; winches disposed on the floating main body and retracting or releasing the ropes fixing the floating main body; fairleads disposed on portions of the floating main body and guiding the ropes to the winches through themselves; and braking units disposed on portions of the floating main body at a predetermined distance from the fairleads, with the ropes passing through the fairleads and themselves, and controlling a speed of the ropes that are retracted to the winches at a predetermined speed, in which the braking unit can control a retracting speed of the ropes that are retracted by the winches at a predetermined speed by pressing the ropes with external force.

The braking unit may include: a first braking member disposed between the fairlead and the winch on the floating main body and controlling the retracting speed of the rope at a predetermined speed through pressurization by external force; and a second braking member manufactured with the same configuration as the first braking member, disposed under the fairlead, and controlling the retracting speed of the rope at a predetermined speed.

The first and second braking members may include: a rope holder disposed on a portion of the floating main body and having the rope through the rope holder; and a stopper disposed on a portion of the rope holder and controlling the retracting speed of the rope that is retracted at a predetermined speed.

The stopper may include: an air tube formed to correspond to an inner side of the rope holder, disposed along the inner side of the rope holder, and surrounding the rope; a hydraulic pump disposed on the floating main body and providing or discharging hydraulic pressure to or from the air tube through pressurization by external force; and a hydraulic line connected to the hydraulic pump and the air tube through a hole formed in the rope holder, thereby providing a passage through which hydraulic pressure is moved.

The rope holder may include: a coupler longitudinally protruding outward a predetermined length from both sides and having at least one threaded hole to be separably coupled to the floating main body; and bolts separably fastened in the thread holes of the coupler and fixing holes formed at the floating main body to correspond to the threaded holes.

The air tube may be made of synthetic resin.

Advantageous Effects

The an apparatus for passively preventing a marine floating body from twisting during mooring according to the present invention can control the retracting speed of ropes through pressurization of a hydraulic pump by installing braking unit on portions of a floating main body in order to give a low Mooring Breaking Limit (MLB) when mooring a floating facility on the sea, and it is also possible to use thin ropes. Accordingly, costs are reduced

DESCRIPTION OF DRAWINGS

FIG. 1 is a perspective view of an apparatus for passively preventing a marine floating body from twisting during mooring according to an embodiment of the present invention.

FIG. 2 is a partial enlarged view of a braking unit.

FIG. 3 is a side view of an anti-twisting device.

FIG. 4 is a view showing another embodiment of the braking unit.

BEST MODE

The following detailed description of the present invention exemplifies specific embodiments for achieving the present invention and refers to the accompanying drawings. The embodiments are described enough for those skilled in the art to be able to achieve the present invention. It should be understood that various embodiments of the present invention are different, but are not exclusive to each other. For example, specific shapes, structures, and characteristics described herein in relation to an embodiment may be achieved through other embodiments without departing from the spirit and scope of the present invention. Further, it should be understood that the positions or arrangement of components in embodiments may be changed without departing from the spirit and scope of the present invention. Accordingly, the following detailed description is not limitative and the scope of the present invention is limited only by the claims and equivalents of the claims. Like reference numerals indicate the same or similar functions in various terms in the drawings.

Exemplary embodiments of the present invention are described in detail with reference to the accompanying drawings so that those skilled in the art can easily achieve the present invention.

FIG. 1 is a perspective view of an apparatus for passively preventing a marine floating body from twisting during mooring according to an embodiment of the present invention, FIG. 2 is a partial enlarged view of a braking unit, FIG. 3 is a side view of an anti-twisting device, and FIG. 4 is a view showing another embodiment of the braking unit.

As shown in FIGS. 1 to 4, an apparatus for preventing a marine floating body from twisting by controlling tension of ropes connected to the marine floating body moored on the sea within a predetermined allowable limit in accordance with the present invention may include a floating main body 100, winches 200, fairleads 300, and braking units 400.

That is, the apparatus prevents mooing ropes from twisting due to weather vaning of a marine floating body. Weather vaning means pivoting of a ship or a floating structure toward the bow due to wind, a current, or waves.

Further, the ropes 30 may be steel wires or chains of which the strength is increased by twisting several pieces of steel wire.

The floating main body 100 is connected to the ropes 30 and fixed on the sea, whereby it can provide a space for marine work.

The floating main body 100 may be synthetic resin such as polyethylene (PE), preferably, medium density polyethylene (MDPE) or high density polyethylene (HDPE) that has high corrosion resistance, mechanical strength, recycling ability and can be easily and strongly bonded and assembled by thermal bonding. Accordingly, the installation process is simplified and a floating material is not easily damaged by waves or external shock. Therefore, the lifespan and safety are improved and it is possible to keep the area of the sea where the floating main body 100 is installed from being contaminated by fragments coming off the floating material.

The winches 200 are disposed on the floating main body 100 and can retract or release the ropes 30 fixing the floating main body 100.

The fairleads 300 are installed on portions of the floating main body 100 and can guide the ropes 30 to the winches 200 through themselves.

The fairleads 300 may be composed of a chock, which is a hole through which a mooring rope etc. passes to the outside, and rollers for preventing wear of the mooring rope.

The braking units 400 are formed on portions of the floating main body 100 at a predetermined distance from the fairleads 300, with the ropes 30 passing through the fairleads 300 and themselves, and can control the speed of the ropes 30 that are retracted to the winches 200 at a predetermined speed.

The braking units 400 can control the speed of the ropes 30 that are retracted by the winches 200 by pressing the ropes 300 with external force.

The braking units 400 may include a first braking member 410 and a second braking member 240.

The first braking member 410 is disposed between the fairlead 300 and the winch 200 on the floating main body 100 and can control the retracting speed of the rope 300 at a predetermined speed through pressurization by external force.

The second braking member 420 is manufactured with the same configuration as the first braking member 410, is disposed under the fairlead 300, and can control the retracting speed of the rope 300 at a predetermined speed.

The first and second braking members 410 and 420 may include a rope holder 500 and a stopper 600.

The rope holder 500 is disposed on a portion of the floating main body 100 and the rope 30 may pass through the rope holder 500.

The rope holder 500 may include a coupler 510 and bolts 520.

The coupler 510 may longitudinally protrude outward a predetermined length from both sides and may have at least one threaded hole 500 to be separably coupled to the floating main body 100.

The bolts 520 can be separably fastened in the threaded holes 50 of the coupler 510 and fixing holes 70 formed at the floating main body 100 to correspond to the threaded holes 50.

That is, the rope bolder 500 is manufactured to be separably attached to the floating main body 100, so it can be easily separated by removing the bolts 520 when it is broken or worn. Accordingly, repair or maintenance is convenient.

In order to install the rope holder 500 to the floating main body 100, other than the method described above, it may be possible to install a coupling rail and a slide corresponding to the coupling rail at corresponding portions on the floating main body 100 and the rope holder 500 and then simply attach/detach the roper holder, or it may be possible to install a clamp on the floating main body 100 and then fix the rope holder 500.

The stopper 600 is installed on a portion of the rope holder 500 and can control the retracting speed of the rope 30 at a predetermined speed.

The stopper 600 may include an air tube 610, a hydraulic pump 620, and a hydraulic line 630.

The air tube 610 is formed to correspond to the inner side of the rope holder 500, is disposed along the inner side of the rope holder 500, and surrounds the rope 30.

The air tube 610 may be made of synthetic resin having excellent elasticity and durability.

The synthetic resin that is used as the material of the air tube 610 may be one or more selected from a group of styrene butadiene rubber (SBR), butadiene rubber (BR), ethylene propylene rubber (EPR), polyurethane (PU), poly (methyl methacrylate) (PMMA), poly(4-vinylpenol) (P4VP), polystyrene-butadiene-block (SBS), polyimide (PI), polyurethane (PU), polyacrylonitrile (PAN), poly(vinyl chloride) (PVC), polypropylene (PP), acrylonitrile butadiene styrene (ABS), polycarbonate/acrylonitrle butadiene styrene (PC/ABS), polyethylene (PE), polyethylene terephthalate (PET), polybutylene terephthalate (PBT), polyphenylene sulfide (PPS), polycarbonate (PC), nylon, low density polyethylene (LDPE), high density polyethylene (HDPE), cross-linked polyethylene (XLPE), tetra-orthosilicate (TEOS), polyaniline, polythiophene, polyethylene dioxythiophene (PEDOT), polyimide, polystyrene sulfonate (PSS), polypyrrole, polyacetylene, poly(p-phenylene), poly (p-phenylene sulfide, poly(p-phenylene vinylene), polythiophene-polyethylene vinylene, polysulfone, polyether sulfone, polyethylene naphthalate, and polyvinyl alcohol (PVA).

The air tube 610 also may be manufactured to be separable from the rope holder 500. That is, the air tube 610 can be separably thread-fastened to the hydraulic line through a hole formed in the rope holder 500. It is possible to dispose a Velcro fastener or a magnet or form a bolt hole at the air tube 610 or the rope holder 500 to couple them with the bolt. Accordingly, when the air tube 610 is damaged or worn, it is possible to simply separate and replace the air tube.

The hydraulic pump 620 is disposed on the floating main body 100 and can provide or discharge hydraulic pressure to or from the air tube 610 through pressurization by external force.

The hydraulic pump 620 is a device converting mechanical energy supplied from the outside into pressure energy of working fluid for a hydraulic system and requires high pressure, so a positive displacement type is generally used.

In general, the hydraulic pressure may be classified into a gear type that supplies pressure using gaps between teeth of two gears, a vane type that pushes and compresses working fluid using vanes on a rotary shaft, a rotary piston type that decreases the volume of cylinders disposed perpendicular to or in parallel with a rotary shaft in the rotational direction of the shaft, a reciprocating piston type that pressurizes working fluid in a cylinder by converting a rotational motion into a reciprocating motion, etc.

Further, it may be classified into a fixed delivery type that pushes a constant volume and a variable delivery type that can change a volume during operation.

In detail, a worker can control the retracting speed of the rope 30 by tightening or loosening the rope 30 by adjusting the air pressure of the air tube 610 while providing or discharging hydraulic pressure to or from the air tube 610 through the hydraulic line 630 by manually operating a button or a control valve on the hydraulic pump 620.

The hydraulic line 630 is connected to the hydraulic pump 620 and the air tube 610 through the hole formed in the rope holder 500, thereby being able to provide a passage through which hydraulic pressure is moved.

The present invention may further include an alarm that is disposed on a portion of the floating main body 100 and gives a warning when the retracting speed of the mooring rope 30 connected to the floating main body 100 exceeds a predetermined speed.

As a method of operating the apparatus for passively preventing a marine floating body from twisting during mooring of the present invention, a worker can prevent the floating main body 100 from twisting when it is moored by controlling the retracting speed of the mooring ropes 30 while controlling operation of the braking units 400 installed on portions of the floating main body 100 close to the fairleads 300 in order to stably moor the floating main body 100 on the sea while retracting the ropes 30 using the winches 200 disposed on the floating main body 100.

To this end, a worker can control the retracting speed of the ropes 30 by tightening or loosening the ropes 30 by adjusting the air pressure of the air tubes 610 disposed in the rope holders 500 while providing or discharging hydraulic pressure to or from the air tubes 610 through the hydraulic lines 630 by manually operating a button or a control valve on the hydraulic pumps 620.

Although the present invention was described above on the basis of exemplary embodiments, it is apparent to those skilled in the art that the spirit of the present invention is not limited thereto and the present invention may be changed or modified within the range described in claims. Further, those changes and modifications will be included in the claims.

REFERENCE NUMERALS

10: Apparatus for preventing twisting
30: Rope
50: Threaded hole
70: Fixing hole
100: Floating main body
200: Winch

300: Fairlead
400: Braking unit
410: First braking member
420: Second braking member
500: Rope holder
510: Coupler
520: Bolt
600: Stopper
610: Air tube
620: Hydraulic pump
630: Hydraulic line

INDUSTRIAL APPLICABILITY

According to the present invention, it is possible to control the retracting speed of ropes through pressurization of a hydraulic pump by installing braking unit on portions of a floating main body 100 in order to give a low Mooring Breaking Limit (MLB) when mooring a floating facility on the sea, and it is also possible to use thin ropes. Accordingly, costs are reduced.

The invention claimed is:

1. An apparatus for passively preventing a marine floating body from twisting during mooring by controlling tension of ropes connected to the marine floating body within a predetermined allowable limit, the apparatus comprising:

a floating main body connected to the ropes, fixed on a sea, and configured to provide a space for marine work;

winches on the floating main body and configured to retract or release the ropes fixing the floating main body;

fairleads on portions of the floating main body and configured to guide the ropes to the winches through themselves; and braking units on portions of the floating main body at a predetermined distance from the fairleads, with the ropes passing through the fairleads and themselves, and configured to control a speed of the ropes that are retracted to the winches at a predetermined speed, wherein the braking units are configured to control a retracting speed of the ropes that are retracted by the winches at a predetermined speed by pressing the ropes with external force, wherein the braking units include, a first braking member between a corresponding one of the fairleads and a corresponding one of the winches on the floating main body and configured to control the retracting speed of a corresponding one of the ropes at a predetermined speed through pressurization by external force, and a second braking member manufactured with the same configuration as the first braking member, the second braking member being under the corresponding one of the fairleads and configured to control the retracting speed of the corresponding one of the ropes at a predetermined speed, wherein the first and second braking members include, a rope holder on a portion of the floating main body and having the corresponding one of the ropes through the rope holder; and a stopper on a portion of the rope holder and configured to control the retracting speed of the corresponding one of the ropes that is retracted at a predetermined speed, and wherein the stopper includes, an air tube corresponding to an inner side of the rope holder, the air tube being along the inner side of the rope holder and surrounding the corresponding one of the ropes, a hydraulic pump on the floating main body and configured to provide or discharge hydraulic pressure to or from the air tube through pressurization by external force, and a hydraulic line connected to the hydraulic pump and the air tube through a hole in the rope holder, and configured to provide a passage through which hydraulic pressure is moved.

2. An apparatus for passively preventing a marine floating body from twisting during mooring by controlling tension of ropes connected to the marine floating body within a predetermined allowable limit, the apparatus comprising:

a floating main body connected to the ropes, fixed on a sea, and configured to provide a space for marine work;

winches on the floating main body and configured to retract or release the ropes fixing the floating main body;

fairleads on portions of the floating main body and configured to guide the ropes to the winches through themselves; and braking units on portions of the floating main body at a predetermined distance from the fairleads, with the ropes passing through the fairleads and themselves, and configured to control a speed of the ropes that are retracted to the winches at a predetermined speed, wherein the braking units are configured to control a retracting speed of the ropes that are retracted by the winches at a predetermined speed by pressing the ropes with external force, wherein the braking units include, a first braking member between a corresponding one of the fairleads and a corresponding one of the winches on the floating main body and configured to control the retracting speed of a corresponding one of the ropes at a predetermined speed through pressurization by external force, and a second braking member manufactured with the same configuration as the first braking member, the second braking member being under a corresponding one of the fairleads and configured to control the retracting speed of the corresponding one of the ropes at a predetermined speed, wherein the first and second braking members include, a rope holder on a portion of the floating main body and having the corresponding one of the ropes through the rope holder, and a stopper on a portion of the rope holder and configured to control the retracting speed of the corresponding one of the ropes that is retracted at a predetermined speed, and wherein the rope holder includes, a coupler longitudinally protruding outward a predetermined length from both sides and having at least one threaded hole to be separably coupled to the floating main body, and bolts separably fastened in the thread holes of the coupler and fixing holes, the fixing holes being at the floating main body to correspond to the threaded holes.

3. The apparatus of claim 1, wherein the air tube is made of synthetic resin.

* * * * *